United States Patent [19]

Fritz

[11] 4,055,959

[45] Nov. 1, 1977

[54] APPARATUS FOR USE IN MINING OR TUNNELLING INSTALLATIONS

[75] Inventor: Giselher Fritz, Werne, Germany

[73] Assignee: Gewerkschaft Eisenhutte Westfalia, Lunen, Germany

[21] Appl. No.: 745,748

[22] Filed: Nov. 29, 1976

[30] Foreign Application Priority Data

Dec. 2, 1975 Germany ..... 2554107

[51] Int. Cl.[2] ..... E01G 3/02

[52] U.S. Cl. ..... 61/85; 61/41 A; 61/42; 61/84

[58] Field of Search ..... 61/84, 85, 42, 41 A, 61/63; 299/31–33

[56] References Cited

U.S. PATENT DOCUMENTS 3,379,024 4/1968 Wohlmeyer ..... 299/31 X 3,863,989 2/1975 Voitsekhovsky et al. ..... 299/31

3,989,302 11/1976 Arrington ..... 61/85 X

FOREIGN PATENT DOCUMENTS 1,271,744 7/1968 Germany ..... 61/85

*Primary Examiner*—Dennis L. Taylor

*Attorney, Agent, or Firm*—Sughrue, Rothwell, Mion, Zinn and Macpeak

[57] ABSTRACT

Apparatus for use in mining or tunnelling installations comprises a shield for housing excavation machinery, and a floor sill for supporting said machinery. The shield is constituted by a plurality of generally cylindrical sections. Means are provided for advancing the shield whilst the floor sill is held stationary. Means are also provided for advancing the floor sill whilst the shield is held stationary.

24 Claims, 3 Drawing Figures

APPARATUS FOR USE IN MINING OR TUNNELLING INSTALLATIONS

BACKGROUND TO THE INVENTION

This invention relates to apparatus for use in mining or tunnelling installations.

Systems are known in which tunnels or headings are driven in rock with the protection of an advancing shield which accommodates a cutting machine and which is caused to follow up in the direction of advance. A permanent lining, for example a steel arch lining, a concrete lining or a brick lining, is introduced behind the advancing shield.

In known shield advancing apparatus, the shield usually has to be shifted as a constructional assembly together with the heavy cutting machinery accommodated therein and with the loading device, as well as the power unit. This necessitates considerable feed power. Moreover, the shield cannot be shifted until the cutting machine has opened up the face being cut, over its full cross-section, to a certain working depth. During the shield advancing operation the cutting work has to stop.

German Specification No. 1,921,314 describes a cutting machine, for underground mine workings, which consists of a frame stand with lining frames arranged side-by-side at a certain distance apart and capable of being shifted by a guiding and shifting device in the direction in which the work progresses. A slide serving as a carrier for a mining device, and displaceable in relation to the frames, is interposed between the latter. Apparatus of this kind is specially intended for the driving of tunnels of small rectangular cross-section. This system does not enable the cross-section of the excavation in the working zone to be screened off in a reliable way, particularly in the case of larger tunnels or headings.

The main aim of the invention is to provide a shield advancing apparatus, for driving headings or tunnels in rock, which is capable of being reliably advanced independently of the cutting machine contained therein.

SUMMARY OF THE INVENTION

The present invention provides apparatus for use in mining or tunnelling installations, the apparatus comprising a shield, for housing excavation machinery, and a floor sill, for supporting said machinery, said shield being constituted by a plurality of generally cylindrical sections, wherein means are provided for advancing said shield and said floor sill, the apparatus being such that said shield and said floor sill can be advanced independently of each other.

Throughout this specification, the term "cylindrical", when used to described said shield sections, should not be construed as meaning "right-circular cylindrical" but should take its broader meaning, namely "having a common cross-section over its entire length".

With this apparatus, it is possible for said shield sections to be advanced one after another independently of said floor sill, without the necessity of simultaneously advancing said excavation machinery resting on said floor sill. It is not absolutely necessary for said excavation machinery to be shut off during the advance of said shield sections. Said shield sections can be advanced either under load or in the unloaded state, as required. The cross-section of the excavation can thus be rapidly and reliably secured in the actual zone of the working face.

Preferably, said shield is constituted by three generally cylindrical sections.

Each section of said shield may be provided with support means for individually supporting that section on the floor of an excavation.

Advantageously, a first set of hydraulic advancing rams constitutes said means for advancing said shield, said rams of said first set being disposed between the shield sections of the or each pair of adjacent shield sections; and a second set of hydraulic advancing rams constitutes said means for advancing said floor sill, said rams of said second set being disposed between the shield sections and the floor sill.

These two sets of hydraulic rams thus enable said shield sections to be advanced one after another prior to said floor sill being subsequently drawn up into position.

Preferably, each shield section is constituted by a frame and a shield member mounted thereon, and said shield members of the or each pair of adjacent shield sections overlap one another telescopically.

Owing to the overlapping of said shield members the zone in which advance occurs can be reliably screened off even while said shield sections are being successively advanced. The resulting adjustability in the length of said shield enables the advance work and the introduction of a permanent lining immediately behind said shield to be effected largely independently of each other, in such a way that the entire zone between the working face and the last lining element introduced is reliably secured in every phase of the process. This system also enables the rear shield section to be advanced in a number of small separate steps, as the introduction of the lining elements proceeds, instead of in one large step.

Advantageously, said hydraulic advancing rams of said first set act between said frames of the or each pair of adjacent shield sections.

Each shield section may be provided with expansion means for pressing it against the wall of the excavation. Advantageously, said expansion means of each shield section constitutes part of said support means of that shield section, and preferably, each of said expansion means is constituted by a respective hydraulic piston-and-cylinder device which, in use, acts on the floor of the excavation by means of a load-distributor such as a skid. These expansion means enable said shield sections to be spread apart and pressed against the walls and roof of the excavation. In the case of any considerable rock pressure or subsidence, said shield sections can be mechanically relieved of their loads by relaxing said expansion means.

Said frame of each section may be provided with a sill beam, said sill beams being displaceable in apertures formed in the underside of said floor sill. In this case, said rams of said second set act between said sill beams and said floor sill.

Said floor sill may be constituted by a number of sill parts positioned one behind another as viewed in the direction of advance, adjacent sill parts being flexibly interconnected, and advantageously, said floor sill is subdivided, in the longitudinal direction, into at least two sill sections which can be shifted independently of one another. Preferably, said floor sill consists of three sill sections. This longitudinal subdivision of said floor sill enables said sill sections to be advanced independently of one another. This is particularly important when use is made of excavation machinery which can be supported either on one sill section or on the other sill section or sections, as desired. Machinery of this kind can be provided, in known manner, with a transporter having caterpillar tracks which usually rest on the middle sill section. In this case the transporter is provided with laterally extensible supporting brackets or the like, which enable the machine to be supported on the outer sill sections. During the excavation work, the machine supports itself, via the extensible supporting brackets, on the outer sill sections, while when the machine is being advanced into a new working position the support is provided by the middle sill section. This system enables said sill sections to be shifted without having to bear the load of the heavy machine in the process.

It is advisable for said sill sections to be made up of a number of flexibly interconnected parts, so that each of said sill sections acts as an articulated chain. It is also advisable for said sill sections to be constructed in such a way that they are guided side-by-side.

To provide a system of directional control the apparatus is preferably so arranged that said sill sections are displaceable transversely in relation to one another in the plane of the floor sill.

The invention may be understood more readily and various other features of the invention may become more apparent from consideration of the following description.

BRIEF DESCRIPTION OF THE DRAWINGS

One form of apparatus for use in mining or tunnelling and constructed in accordance with the invention will now be described, by way of example, with reference to the accompanying drawings, in which.

DESCRIPTION OF PREFERRED EMBODIMENT

Figure 1:
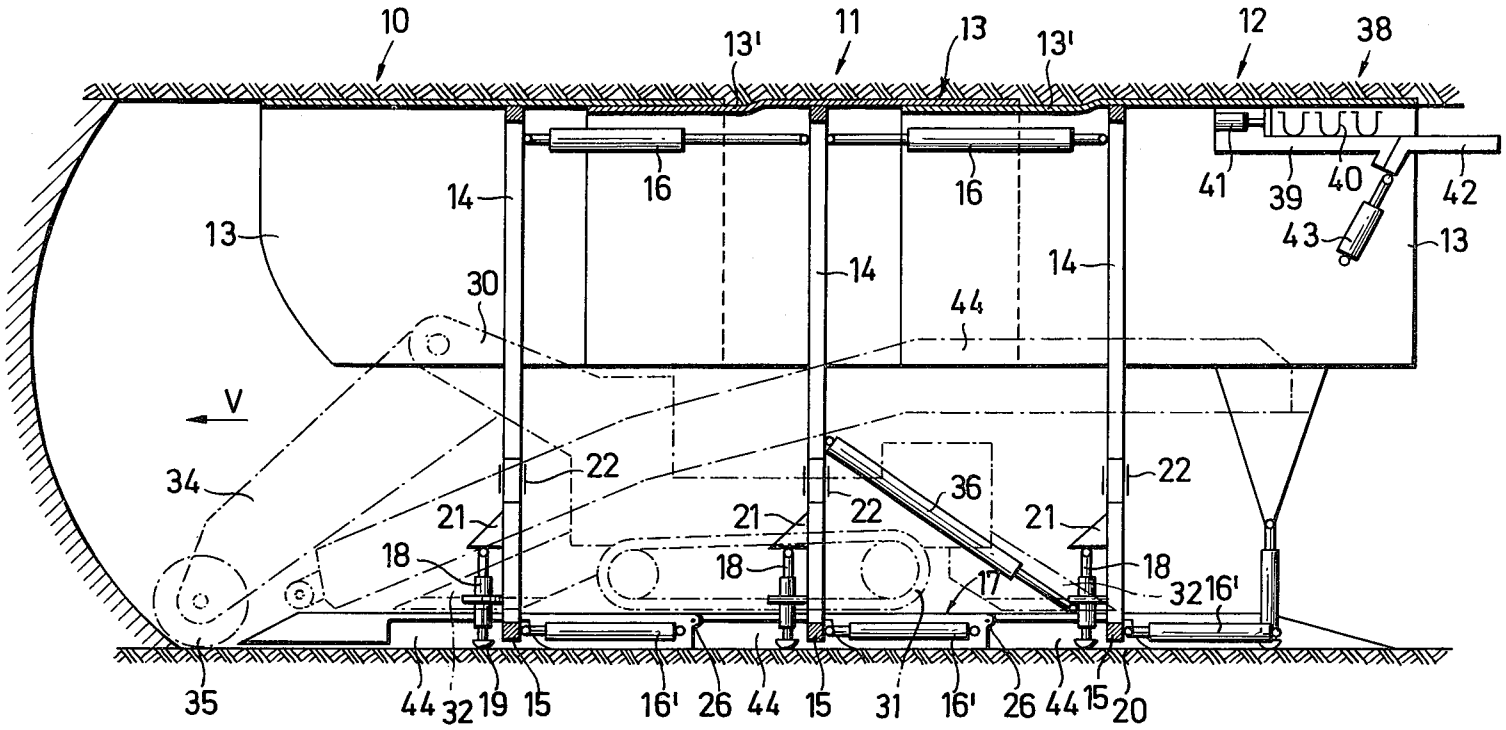
FIG. 1 is a longitudinal section through the apparatus.

Referring to the drawings, FIG. 1 shows a shield constituted by three generally cylindrical shield sections 10, 11 and 12, arranged end-to-end in the direction in which they are to be moved during use. Each section consists of a shield member 13, which supports the roof and sides of the excavated tunnel, and also of a frame 14 rigidly connected to its shield member. Each frame 14 is constituted by a number of steel arc segments which are interconnected, in the floor zone, via a floor beam 15, to form a rigid self-contained frame. As may be seen from FIG. 1, the shield members 13 of the two rear shield sections 11 and 12 are bent inwards at 13' by a distance approximately equal to the thickness of the sheet metal from which they are made, so that the shield members overlap one another. Advancing rams 16 are provided for moving the shield sections in the direction V in the socalled "retarded follow-up sequence", that is to say the front section 10 is advanced in the direction V whilst the other two sections 11 and 12 are stationary, the second section 11 is then advanced to follow up the first section 10 and finally the third section 12 is advanced. The length of overlap between each pair of adjacent sections 10, 11 and 12 is arranged to be greater than the strokes of the rams 16 so that the three sections are always telescoped together during this advancing movement. The rams 16, positioned in the roof zone are flexibly interposed between the frames 14 of the successive shield sections, and rams 16' are also provided adjacent to the floor and act flexibly between the floor beams 15 and a floor sill 17 via joints (not shown).

The frames 14 are each provided, in the floor zone, with expansion elements in the form of hydraulic piston-and-cylinder devices 18 which are supported on the floor 20 by skids 19, and which act on connecting brackets 21 attached to the frames 14. The arc segments of each frame are detachably and adjustably interconnected via mechanical connections such as bolts or straps 22.

Figure 2:
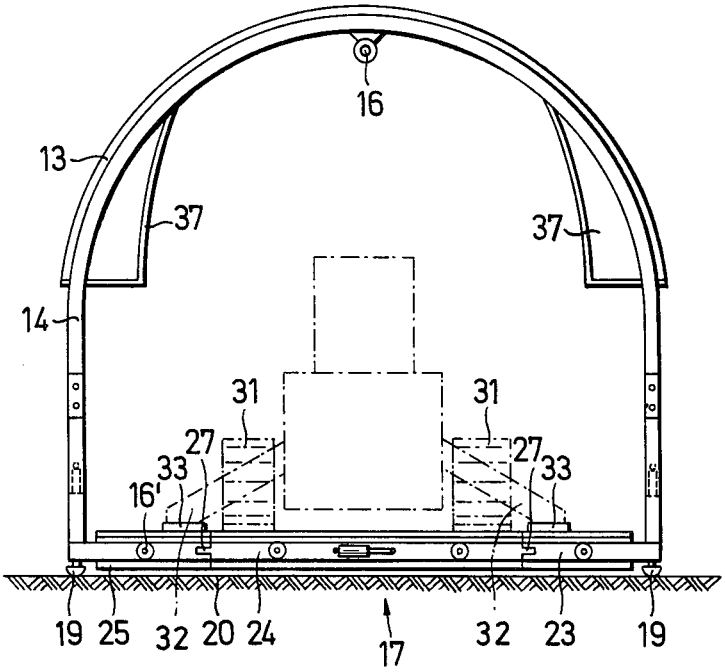
FIG. 2 is an end elevation of the apparatus of FIG. 1.
Figure 3:
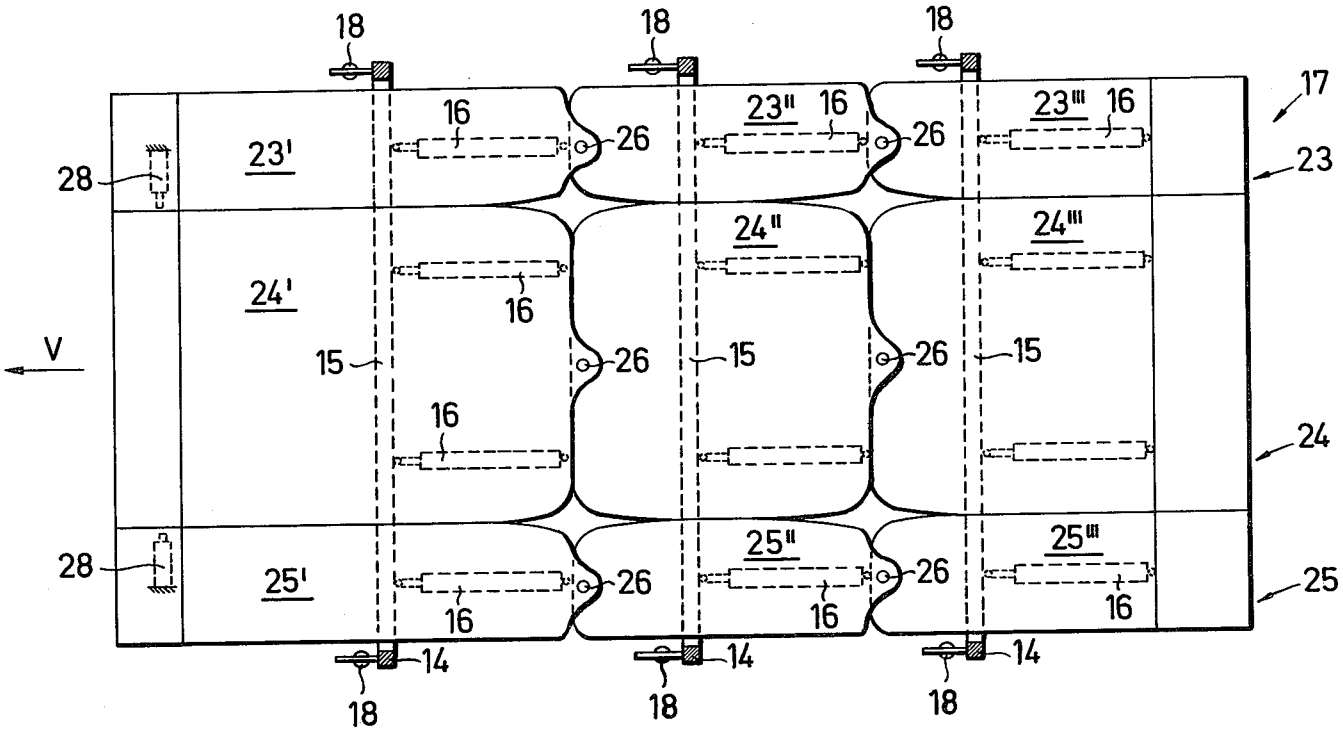
FIG. 3 is a plan view of the multi-part floor sill of the apparatus of FIGS. 1 and 2.

The structure of the floor sill 17 (see FIGS. 2 and 3) is subdivided longitudinally into three sill sections 23, 24 and 25, of which the middle sill section 24 has a width considerably greater than that of the outer sill sections 23 and 25. Each sill section in itself consists of a number of sill parts 23', 23'' and 23''', 24', 24'' and 24''', and 25', 25'' and 25''', interconnected, at joints 26, to form an articulated chain. The sill parts are given a sufficient clearance to ensure that, within certain limits, they are flexibly movable with respect to one another in all directions. The sill sections 23, 24, and 25 are guided (see FIG. 2), on their respective longitudinal side edges which face towards one another, by means of longitudinal guides 27, which have sufficient clearance to allow of directional control of the shield. Control members in the form of hydraulic piston and cylinder devices 28 are provided for bending the sill sections slightly aside from one another, in the horizontal plane, so that the direction of advance of the shield sections 10, 11 and 12 can be influenced as desired.

As can be seen in FIG. 1, the rams 16' and the floor beams 15 are situated underneath the floor sill 17, and the sill sections are provided, in their undersides, with chambers or recesses 44 each of whose length is at least equal to the stroke of the rams 16' and each of whose height is greater than that of the beams 15, so that, on the retraction and extension of the expansion elements 18, the beams 15 have sufficient vertical play in the recesses 44.

Thus, by applying pressure to the rams 16 the shield sections 10, 11 and 12 can be advanced independently of the floor sill 17, in successive steps in the direction V. During this process the shield sections 10, 11 and 12 are supported, via their frames 14 and the expansion elements 18, against the floor 20. They are also supported on one another by the overlapping parts of the shield members 13. When the shield sections 10, 11 and 12 are advanced, the expansion elements 18 can be retracted until the shield members 13 are completely relieved of their load. Alternatively, the shield sections 10, 11 and 12 can also be shifted with the shield members 13 under load, with the expansion elements 18 extended.

As soon as all the shield sections 10, 11 and 12 have been advanced, the advance of the floor sill 17 can be effected. This operation is performed by means of the rams 16', which act against the braced frames 14 of the shield sections 10, 11 and 12. In this process it is possible, for example, to advance the two outer sill sections 23 and 25 as a first step, the middle sill section 24 being advanced subsequently thereto.

An excavating machine 30, such as a cutter, is provided with a transporter having caterpillar tracks 31. Normally, these tracks 31 run on the middle sill section 24 of the floor sill 27, but the machine 30 is provided with hydraulically extensible side brackets 32 by means of which it can be supported on continuous supporting rails 33 provided on the outer sill sections 23 and 25. Thus, the machine 30, together with its caterpillar tracks 31, can be lifted off the middle sill section 24. When in use, the machine 30 is usually supported on the outer sill sections 23 and 25 via the brackets 32. If the machine 30 is to be moved forwards, the brackets 32 are hydraulically retracted, so that the caterpillar tracks 31 are lowered onto the middle sill section 24. The machine 30 may be of any known type. The machine shown has a pivotable extension arm 34 provided with a rotary cutting device 35.

It will be apparent, therefore, that the shield sections 10, 11 and 12 can be advanced independently of the floor sill 17 without the necessity of interrupting the work performed by the machine 30. The operation of advancing the sill sections 23, 24 and 25 of the floor sill 27 can be carried out without subjecting them to any load.

Hydraulic alignment piston-and-cylinder devices 36 are interposed between the frame 14 of the middle shield section 11 and the floor sill 17, these devices 36 providing a means of aligning the apparatus. The joints 26 connecting the sill parts, the joints between the rams 16 and the frames 14, and the joints connecting the alignment devices 36 and the sill 17, are all constructed as articulated joints which enables the entire shield apparatus to travel around bends. For the same purpose the connecting joints of the expansion elements 18 and the rams 16' are designed as articulated joints.

The overlapping shield members 13 are provided with sliding air ducts 37 (see FIG. 2) designed on space-saving lines and serving for ventilation. The rear shield section 12 is also provided with a lining setting device 38 having a magazine 39 loaded with lining segments 40 (see FIG. 1) of the arch-type. These members 40 are to constitute the permanent lining immediately behind the shield and are pushed individually out of the magazine 39 by means of hydraulic piston-and-cylinder devices 41 and onto a lifting device 42 which can be raised towards the roof of the tunnel by means of hydraulic piston-and-cylinder devices 43. In practice, the rear shield section 12 may be shifted by a distance corresponding to that provided between the individual lining arches 40 of the permanent lining, rather than by the full distance of its overlap with section 11. After this shifting operation the arch 40 furthest from the devices 41 is pushed by these devices onto the lifting device 42, which is then raised towards the roof by means of the lifting devices 43. This lining arch is thus moved into the lining position, after which it can be bolted and tightened. This process is then repeated for the next arch 40 so as to provide a simple and rapid means of lining which is independent of the progress of the machine 30. Needless to say, the lining setting device 38 also enables other lining elements to be introduced into the tunnel. In place of a lining setting device and magazine, it is also possible for a hydraulically displaceable scaffolding for shaped brakes to be built onto the rear shield section 12 if the lining selected is of the type consisting of such shaped brakes.

The shield described above can be shifted in a stable and reliable manner even under extremely difficult conditions, that is to say when there is no contact at all with the rock or when loose rubble rests on the entire working. Any pressure exerted by the strata is taken up by the expansion elements 18. In the event of any appreciable subsidence the shield can be relieved of its load mechanically.

I claim:

1. Apparatus for supporting and shielding excavation machinery for use in mining or tunnelling operations, said apparatus comprising:

a. a floor sill for supporting said machinery;

b. a shield for shielding said machinery, said shield being constituted by a plurality of generally cylindrical shield sections;

c. means for advancing said shield whilst said floor sill remains stationary; and d. means for advancing said floor sill whilst said shield remains stationary;

whereby, during operation, said shield is advanced relative to said floor sill and then subsequently, said floor sill is drawn up to follow the advancement of said shield.

2. Apparatus according to claim 1, wherein said shield is constituted by three generally cylindrical shield sections.

3. Apparatus according to claim 1, wherein each section of said shield is provided with support means for individually supporting that section on the floor of an excavation.

4. Apparatus according to claim 1, wherein a first set of hydraulic advancing rams constitutes said means for advancing said shield, said rams of said first set being disposed between the shield sections of the or each pair of adjacent shield sections.

5. Apparatus according to claim 4, wherein a second set of hydraulic advancing rams constitutes said means for advancing said floor sill, said rams of said second set being disposed between said shield sections and said floor sill.

6. Apparatus according to claim 1, wherein each shield section is constituted by a frame and a shield member mounted thereon.

7. Apparatus according to claim 6, wherein said shield members of the or each pair of adjacent shield sections overlap one another telescopically.

8. Apparatus according to claim 6, wherein said hydraulic advancing rams of said first set act between said frames of the or each pair of adjacent shield sections.

9. Apparatus according to claim 1, wherein each shield section is provided with expansion means for pressing it against the wall of an excavation.

10. Apparatus according to claim 9, wherein said expansion means of each shield section constitutes part of said support means of that shield section.

11. Apparatus according to claim 10, wherein each of said expansion means is constituted by a respective hydraulic piston-and-cylinder device which acts on the floor of said excavation by means of a skid.

12. Apparatus according to claim 6, wherein said frame of each shield section is provided with a sill beam, said sill beams being displaceable in apertures formed in the underside of said floor sill.

13. Apparatus according to claim 1, wherein said floor sill is constituted by a number of sill parts positioned one behind another as viewed in the direction of advance, adjacent sill parts being flexibly interconnected.

14. Apparatus according to claim 1, wherein said floor sill is subdivided, in the longitudinal direction, into at least two sill sections which can be shifted independently of one another.

15. Apparatus according to claim 14, wherein said floor sill consists of three sill sections.

16. Apparatus according to claim 15, wherein the middle sill section of said three sill sections is greater in width than the two outer sill sections.

17. Apparatus according to claim 14, wherein said rams of said second set are disposed between said sill sections and said sill beams of said shield sections.

18. Apparatus according to claim 14, wherein each sill section acts as an articulated chain.

19. Apparatus according to claim 14, wherein guide means are provided for guiding said sill sections side-by-side.

20. Apparatus according to claim 14, wherein said sill sections are displaceable transversely in relation to one another in the plane of said floor sill.

21. Apparatus according to claim 1, wherein the rear shield section is fitted with an auxiliary device serving to introduce a permanent lining into the excavation.

22. Apparatus according to claim 21, wherein said auxiliary device includes a magazine for storing lining elements.

23. Apparatus for supporting and shielding excavation machinery for use in mining or tunnelling operations, said apparatus comprising:

a. A floor sill for supporting said machinery;

b. a shield for shielding said machinery, said shield being constituted by a plurality of generally cylindrical shield sections; and c. means for advancing said shield whilst said floor sill remains stationary and for advancing said floor sill whilst said shield remains stationary;

whereby, during operation, said shield is advanced relative to said floor sill and then subsequently, said floor sill is drawn up to follow the advancement of said shield.

24. Apparatus for supporting and shield excavation machinery for use in mining or tunnelling operations, said apparatus comprising:

a. a floor sill for supporting said machinery, said floor sill being subdivided, in the longitudinal direction, into three sill sections;

b. a shield for shielding said machinery, said shield being constituted by three generally cylindrical shield sections each of which comprises a frame, a sill beam and a shield member mounted thereon;

c. a first set of hydraulic advancing rams for advancing said shield sections one after another whilst said floor sill remains stationary, said rams of said first set acting between said frames of each pair of adjacent shield sections; and d. a second set of hydraulic advancing rams for advancing said floor sill whilst said shield remains stationary, said rams of said second set acting between said sill sections and said sill beams of said shield sections;

whereby, during operation, said shield sections are advanced one after another relative to said floor sill and then subsequently, said floor sill sections are drawn up to follow the advancement of said shield.

* * * * *